US012768013B2

(12) United States Patent
Totani et al.

(10) Patent No.: US 12,768,013 B2
(45) Date of Patent: Oct. 20, 2026

(54) ALUMINUM ALLOY SHEET, METHOD FOR MANUFACTURING SAME, AND HEAT EXCHANGER

(71) Applicant: UACJ Corporation, Tokyo (JP)

(72) Inventors: Yuki Totani, Tokyo (JP); Takeyoshi Doko, Tokyo (JP)

(73) Assignee: UACJ CORPORATION, Tokyo (JP)

( * ) Notice: Subject to any disclaimer, the term of this patent is extended or adjusted under 35 U.S.C. 154(b) by 474 days.

(21) Appl. No.: 18/276,483

(22) PCT Filed: Jan. 6, 2022

(86) PCT No.: PCT/JP2022/000183

§ 371 (c)(1),
(2) Date: Aug. 9, 2023

(87) PCT Pub. No.: WO2022/176420

PCT Pub. Date: Aug. 25, 2022

(65) Prior Publication Data

US 2024/0117473 A1 Apr. 11, 2024

(30) Foreign Application Priority Data

Feb. 16, 2021 (JP) ..... 2021-022372

(51) Int. Cl.

| | |
|---|---|
| ***C22C 21/02*** | (2006.01) |
| ***C21D 8/02*** | (2026.01) |
| ***C21D 8/0221*** | (2026.01) |
| ***C21D 8/0247*** | (2026.01) |
| ***C21D 9/46*** | (2006.01) |
| ***C22F 1/04*** | (2006.01) |
| ***C22F 1/043*** | (2006.01) |

(52) U.S. Cl.
CPC ..... *C22C 21/02* (2013.01); *C21D 8/0236* (2013.01); *C21D 8/0273* (2013.01); *C21D 9/46* (2013.01); *C22F 1/043* (2013.01)

(58) Field of Classification Search
CPC ..... C22C 21/02; C22C 21/04; C22C 21/00; C22F 1/043; C21D 8/0236; C21D 8/0273
See application file for complete search history.

(56) References Cited

U.S. PATENT DOCUMENTS

| | | | |
|---|---|---|---|
| 2015/0050520 | A1 | 2/2015 | Niikura et al. |
| 2016/0089860 | A1 | 3/2016 | Kurosaki et al. |
| 2016/0116234 | A1 | 4/2016 | Murase et al. |
| 2019/0153576 | A1 | 5/2019 | Kurosaki |
| 2019/0162492 | A1 | 5/2019 | Kurosaki et al. |

FOREIGN PATENT DOCUMENTS

| | | | | |
|---|---|---|---|---|
| CN | 105229182 | A | 1/2016 | |
| JP | 5345264 | B1 | 11/2013 | |
| JP | 5436714 | B2 | 3/2014 | |
| JP | 2019-94517 | A | 6/2019 | |
| JP | 2020-100881 | A | 7/2020 | |
| KR | 10-2016-0009600 | A | 1/2016 | |
| WO | 2013/080650 | A1 | 6/2013 | |
| WO | WO-2013111884 | A1 * | 8/2013 | ..... B23K 35/286 |
| WO | 2014/184880 | A1 | 11/2014 | |
| WO | 2014/196183 | A1 | 12/2014 | |
| WO | 2017/179625 | A1 | 10/2017 | |

OTHER PUBLICATIONS

English Abstract and English Machine Translation of Fujita et al. (WO 2013/111884) (Aug. 1, 2013).*
English Abstract and English Machine Translation of Iwao et al. (JP 2020-010088)(Jul. 2, 2020).*
Office Action dated Apr. 30, 2025, issued in counterpart CN Application No. 202280015276.X, with English translation. (15 pages).
International Search Report dated Mar. 22, 2022, issued in counterpart International Application No. PCT/JP2022/000183, with English Translation. (7 pages).
Written Opinion of the International Searching Authority (Form PCT/ISA/237) dated Mar. 22, 2022, issued in counterpart International Application No. PCT/JP2022/000183. (6 pages).
Office Action dated Dec. 5, 2025, issued in counterpart CN Application No. 202280015276.X, with English translation. (15 pages).
Office Action dated Feb. 26, 2026, issued in counterpart KR Application No. 10-2023-7022956, with English translation. (13 pages).
Rejection Decision dated Mar. 28, 2026, issued in counterpart CN Application No. 202280015276.X, with English translation (21 pagres).

* cited by examiner

*Primary Examiner* — Jessee R Roe
(74) *Attorney, Agent, or Firm* — WHDA, LLP

(57) ABSTRACT

An aluminum alloy sheet includes a function of heat joining in a single layer. The aluminum alloy sheet is formed of an aluminum alloy comprising: Si of 1.50 to 5.00 mass %; Fe of 0.01 to 2.00 mass %; and Mn of 0.50 to 2.00 mass %, with the balance being Al and inevitable impurities. In a heating test in which a temperature is raised from 300° C. to 400° C. at an average temperature rising rate of 60° C./min or less and held at 600±3° C. for 5±3 minutes, average grain size in a plane parallel to a rolled surface after the heating test is 370 μm or more, and an average number of grains in a sheet thickness direction after the heating test is 1.5 pieces or more.

8 Claims, 5 Drawing Sheets

ALUMINUM ALLOY SHEET, METHOD FOR MANUFACTURING SAME, AND HEAT EXCHANGER

TECHNICAL FIELD

The present invention relates to an aluminum alloy sheet for single-layer heat joining and a heat exchanger manufactured by using the same.

BACKGROUND ART

Brazing is often used in methods for manufacturing products such as heat exchangers and heat sinks that are formed of aluminum material and have many metal joints. As an aluminum material for brazing, a brazing sheet on which a brazing filler metal has been clad to a core formed of aluminum material or a preplaced brazing filler metal has been used. However, the use of clad materials such as brazing sheets for joining a plurality of layers to each other after stacking them and additional joining materials such as preplaced brazing filler metals have contributed to the rising cost of heat exchangers and other equipment due to manufacturing costs and material costs thereof.

In view of this, an aluminum alloy material that can be heat joined in a single layer has been proposed in recent years (e.g., Patent Literature 1). This aluminum alloy material contains an Al—Si-based alloy, and the liquid phase generated inside the alloy material by heating is used for joining. With this aluminum alloy material, the liquid phase described above acts as a brazing filler metal, and thus it can be joined to other members without using a joining material such as a preplaced brazing filler metal although it has only a single layer. In the present invention, the capability of joining by heating even without a joining material in this manner is called "heat joining function". The joining by such an aluminum alloy material having the heat joining function in a single layer is called "heat joining", and the heating temperature at that time is called "heat joining temperature".

For the aluminum alloy material having the heat joining function in a single layer, the material changes into a semi-molten state during the heat joining, and thus it is important to ensure deformation resistance at brazing temperature. As a method for improving deformation resistance in an aluminum alloy material, for example, Patent Literature 2 discloses an aluminum alloy material having excellent deformation resistance and the heat joining function in a single layer, which is obtained by using a metal structure that allows grains to become coarse after heating for brazing and suppresses the formation of the liquid phase at grain boundaries.

CITATION LIST

Patent Literature

Patent Literature 1: Japanese Patent 5436714
Patent Literature 2: Japanese Patent 5345264

SUMMARY OF INVENTION

Technical Problem

However, according to studies of the inventors of the present invention, a conventional aluminum alloy material having the heat joining function in a single layer may have insufficient deformation resistance during heat joining.

In view of this, it is an object of the present invention to provide an aluminum alloy sheet having a function of heat joining in a single layer, which is an aluminum alloy sheet having high resistance to deformation during heat joining.

Solution to Problem

In order to solve the above problem, the inventors studied the relation between a crystal structure after heat joining and deformation resistance of aluminum alloy materials having the function of heat joining in a single layer, and consequently found that grain boundary sliding caused by grains in the sheet thickness direction affects the deformation resistance. The inventors then found that an aluminum alloy material having the function of heat joining in a single layer and excellent deformation resistance is obtained by controlling the metal structure of an aluminum alloy sheet (metal structure before heat joining) into a metal structure in which the respective structures in a plane parallel to a rolled surface and in the sheet thickness direction after heating by heat joining are set in an appropriate state, and have completed the present invention.

That is, the present invention (1) provides an aluminum alloy sheet having a function of heat joining in a single layer, the aluminum alloy sheet formed of an aluminum alloy comprising: Si of 1.50 to 5.00 mass %; Fe of 0.01 to 2.00 mass %; and Mn of 0.50 to 2.00 mass %, with the balance being Al and inevitable impurities, wherein in a heating test in which a temperature is raised from 300° C. to 400° C. at an average temperature rising rate of 60° C./min or less and held at 600±3° C. for 5±3 minutes, average grain size in a plane parallel to a rolled surface after the heating test is 370 μm or more, and an average number of grains in a sheet thickness direction after the heating test is 1.5 pieces or more.

The present invention (2) provides the aluminum alloy sheet according to (1), further comprising any one or two or more among Zn of 6.00 mass % or less, Mg of 3.00 mass % or less, Cu of 1.50 mass % or less, Ni of 2.00 mass % or less, Cr of 0.30 mass % or less, Zr of 0.30 mass % or less, Ti of 0.30 mass % or less, and V of 0.30 mass % or less.

The present invention (3) provides the aluminum alloy sheet according to (1) or (2), further comprising any one or two or more among Be of 0.10 mass % or less, Sr of 0.10 mass % or less, Bi of 0.30 mass % or less, Na of 0.10 mass % or less, and Ca of 0.05 mass % or less.

The present invention (4) provides the aluminum alloy sheet according to any one of (1) to (3), wherein a sheet thickness is 0.30 mm or less.

The present invention (5) provides a method for manufacturing an aluminum alloy sheet, the method comprising:

a casting step of casting a cast-rolled sheet of an aluminum alloy comprising Si of 1.50 to 5.00 mass %, Fe of 0.01 to 2.00 mass %, and Mn of 0.50 to 2.00 mass %, with the balance being Al and inevitable impurities by continuous casting rolling; and a cold-rolling step of cold rolling the cast-rolled sheet two or more times, wherein annealing is performed one or more times between after the casting step and before a final cold rolling at the cold-rolling step, and annealing conditions for all annealings are set such that an annealing temperature is 200 to 550° C. and an annealing time is 1 to 10 hours.

The present invention (6) provides the method for manufacturing an aluminum alloy sheet according to (5), wherein the cast-rolled sheet further comprises any one or two or more among Zn of 6.00 mass % or less, Mg of 3.00 mass % or less, Cu of 1.50 mass % or less, Ni of 2.00 mass % or less, Cr of 0.30 mass % or less, Zr of 0.30 mass % or less, Ti of 0.30 mass % or less, and V of 0.30 mass % or less.

The present invention (7) provides the method for manufacturing an aluminum alloy sheet according to (5) or (6), wherein the cast-rolled sheet further comprises any one or two or more among Be of 0.10 mass % or less, Sr of 0.10 mass % or less, Bi of 0.30 mass % or less, Na of 0.10 mass % or less, and Ca of 0.05 mass % or less.

The present invention (8) provides a heat exchanger comprising a tube made of aluminum alloy through which a working fluid flows and a fin made of aluminum alloy metallically joined to the tube, wherein the tube is formed using a heat-exchanger tube material formed of an aluminum alloy, the fin is formed using an aluminum alloy sheet formed of an aluminum alloy comprising Si of 1.50 to 5.00 mass %, Fe of 0.01 to 2.00 mass %, and Mn of 0.50 to 2.00 mass % with the balance being Al and inevitable impurities, and having a function of heat joining in a single layer, and average grain size in a plane parallel to a rolled surface of the fin is 370 μm or more, and an average number of grains in a sheet thickness direction is 1.5 pieces or more.

The present invention (9) provides the heat exchanger according to (8), wherein the fin further comprises any one or two or more among Zn of 6.00 mass % or less, Mg of 3.00 mass % or less, Cu of 1.50 mass % or less, Ni of 2.00 mass % or less, Cr of 0.30 mass % or less, Zr of 0.30 mass % or less, Ti of 0.30 mass % or less, and V of 0.30 mass % or less.

The present invention (10) provides the heat exchanger according to (8) or (9), wherein the fin further comprises any one or two or more among Be of 0.10 mass % or less, Sr of 0.10 mass % or less, Bi of 0.30 mass % or less, Na of 0.10 mass % or less, and Ca of 0.05 mass % or less.

The present invention (11) provides a heat exchanger comprising a tube made of aluminum alloy through which a working fluid flows and a fin made of aluminum alloy metallically joined to the tube, wherein the heat exchanger is obtained by combining at least a heat-exchanger tube material formed of an aluminum alloy and a heat-exchanger fin material formed of an aluminum alloy, and then heating the resulting combined body to join the heat-exchanger tube material and the heat-exchanger fin material, and the heat-exchanger fin material is a formed body of the aluminum alloy sheet according to any one of (1) to (4).

According to the present invention, an aluminum alloy sheet having a function of heat joining in a single layer, which is an aluminum alloy sheet having high resistance to deformation during heat joining is provided.

DESCRIPTION OF EMBODIMENTS

Figure 1:
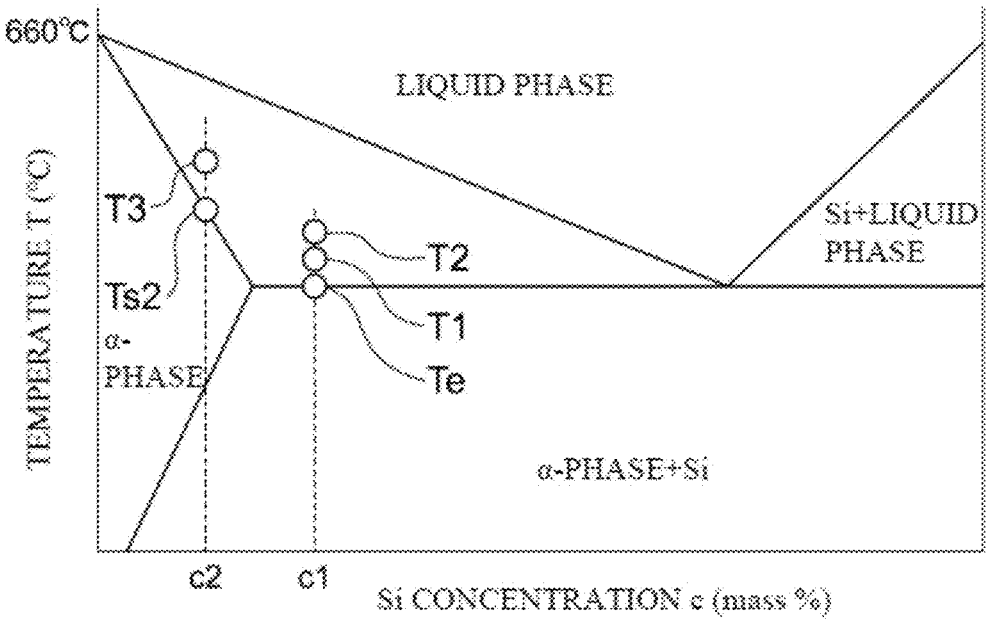
FIG. 1 is a schematic phase diagram of an Al-Si alloy that is a typical binary-phase eutectic alloy.
Figure 2A:
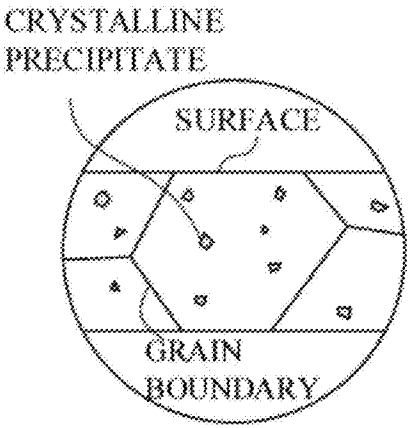
FIGS. 2 (*a*)-2 (d) are explanatory diagrams illustrating a liquid phase formation mechanism in an aluminum alloy for forming of an aluminum alloy sheet according to the present invention in joining using the aluminum alloy sheet according to the present invention.
Figure 2B:
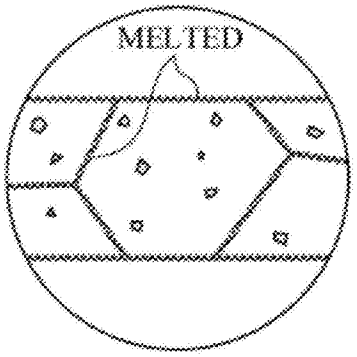
Figure 2C:
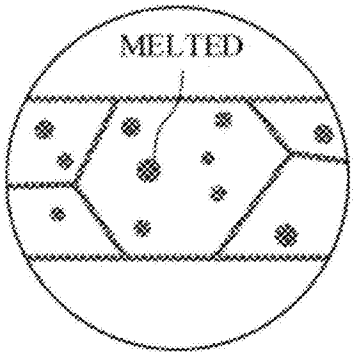
Figure 2D:
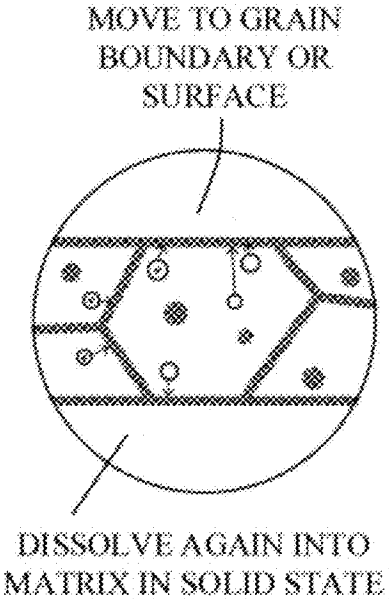
Figure 3A:
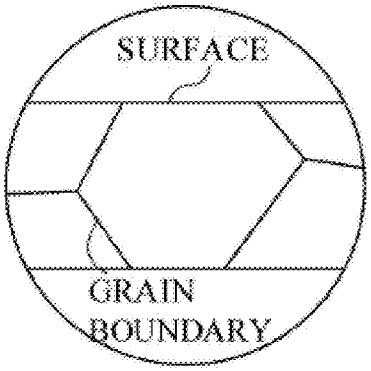
FIGS. 3 (*a*)-3 (d) are explanatory diagrams illustrating a liquid phase formation mechanism in an aluminum alloy for forming of an aluminum alloy sheet according to the present invention in joining using the aluminum alloy sheet according to the present invention.
Figure 3B:
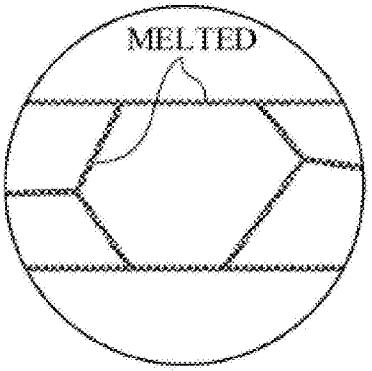
Figure 3C:
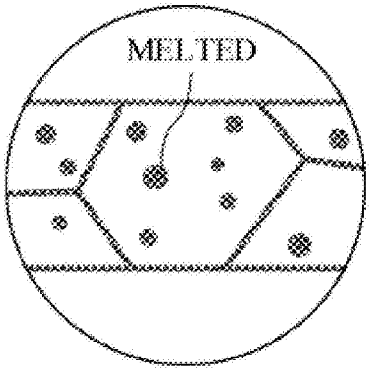
Figure 3D:
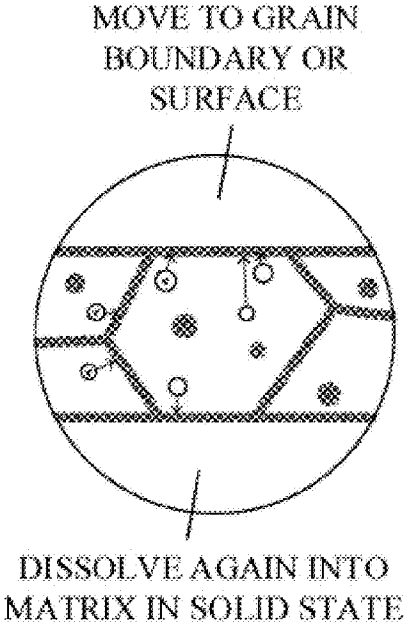

An aluminum alloy sheet according to the present invention is an aluminum alloy sheet having a function of heat joining in a single layer, the aluminum alloy sheet formed of an aluminum alloy comprising: Si of 1.50 to 5.00 mass %; Fe of 0.01 to 2.00 mass %; and Mn of 0.50 to 2.00 mass %, with the balance being Al and inevitable impurities, wherein in a heating test in which the temperature is raised from 300° C. to 400° C. at an average temperature rising rate of 60° C./min or less and held at 600±3° C. for 5±3 minutes, the average grain size in a plane parallel to a rolled surface after the heating test is 370 μm or more, and the average number of grains in a sheet thickness direction after the heating test is 1.5 pieces or more.

The aluminum alloy sheet according to the present invention comprises Si, Fe and Mn as essential elements. The aluminum alloy sheet according to the present invention is formed by the essential elements, optional additive elements added as necessary, and as the balance other than these, aluminum and inevitable impurities.

The aluminum alloy sheet according to the present invention is formed by an aluminum alloy comprising: Si of 1.50 to 5.00 mass %; Fe of 0.01 to 2.00 mass %; and Mn of 0.50 to 2.00 mass %, with the balance being Al and inevitable impurities. In other words, the aluminum alloy sheet according to the present invention is formed by the aluminum alloy.

The aluminum alloy for the aluminum alloy sheet according to the present invention may further comprise, as the optional additive elements, any one or two or more among Zn of 6.00 mass % or less, Mg of 3.00 mass % or less, Cu of 1.50 mass % or less, Ni of 2.00 mass % or less, Cr of 0.30 mass % or less, Zr of 0.30 mass % or less, Ti of 0.30 mass % or less, V of 0.30 mass % or less, Be of 0.10 mass % or less, Sr of 0.10 mass % or less, Bi of 0.30 mass % or less, Na of 0.10 mass % or less, and Ca of 0.05 mass % or less. The aluminum alloy for the aluminum alloy sheet according to the present invention may also comprise In of 0.10 mass % or less, Sn of 0.10 mass % or less, and rare earth elements of 0.10 mass % or less as the optional additive elements.

Si is an element that forms an Al—Si-based liquid phase to contribute to joining. The Si content in the aluminum alloy for the aluminum alloy sheet according to the present invention is 1.50 to 5.00 mass %, preferably 1.60 to 3.50 mass %, more preferably 2.00 to 3.00 mass %. When the Si content in the aluminum alloy is within this range, a sufficient amount of liquid phase can be formed, allowing satisfactory joining to be obtained because the amount of liquid phase bleeding is sufficient, and also the material strength does not decrease too much during heating, allowing the material to maintain its shape. Furthermore, when the Si content in the aluminum alloy is within the above-described range, the temperature difference between a solidus and a liquidus of the aluminum alloy is larger, resulting in a longer time for solidification to be completed during casting near the center of the sheet thickness. As a result, solute atoms are discharged from near the surface layer to the center, and second-phase particles are present densely due to the more concentrated solute atoms, whereby grain growth in the center of the sheet thickness is inhibited. Thus, during heat joining, the number of grains in the sheet thickness direction increases, and deformation due to grain boundary sliding is suppressed. The thicker a sheet and the higher a heating temperature, the larger is the amount of the bleeding liquid phase. Thus, the amount of the liquid phase required during the heat joining is adjusted in accordance with the structure or dimensions of fins of a heat exchanger to be manufactured, and the Si content in the aluminum alloy and the heat joining temperature are adjusted in accordance with the amount of the liquid phase required during the heat joining. If the Si content in the aluminum alloy is less than the above-described range, a sufficient amount of liquid phase cannot be formed, resulting in less liquid phase bleeding and incomplete joining. If the Si content exceeds the above-described range, Si particles in the aluminum alloy material increases and the amount of the formed liquid phase increases, and thus the material strength during the heating significantly decreases, which makes it very difficult to maintain the shape as a fin material.

Fe has an effect of increasing the strength by slightly dissolving into the matrix in a solid state, and also has an effect of preventing reduction of the strength at high temperature in particular by dispersing as crystallized substances or precipitates. The Fe content in the aluminum alloy for the aluminum alloy sheet according to the present invention is 0.01 to 2.00 mass %, preferably 0.20 to 1.00 mass %. When the Fe content in the aluminum alloy is within this range, the strength is higher and reduction of the strength at high temperature can be prevented. If the Fe content in the aluminum alloy is less than this range, not only the above-described effect is small, but also costs increase due to the need to use an ingot with higher purity. If the Fe content in the aluminum alloy exceeds this range, coarse intermetallic compounds are formed during casting, causing manufactural problems, and corrosion resistance decreases when a joined body is exposed to a corrosive environment (especially a corrosive environment where liquid flows), and furthermore, recrystallized grains become finer by heating during joining, resulting in lower deformation resistance.

Mn dissolves into the aluminum matrix in a solid state during casting, and promotes the formation of Al-based intermetallic compounds having equivalent diameters of 0.01 to 0.50 μm in the subsequent machining process. The Mn content in the aluminum alloy for the aluminum alloy sheet according to the present invention is 0.50 to 2.00 mass %, preferably 0.80 to 1.50 mass %. When the Mn content in the aluminum alloy is within this range, Al-based intermetallic compounds having equivalent diameters of 0.01 to 0.50 μm are present in a sufficient amount, a pinning effect of appropriate strength can be obtained, and only limited grains grow, resulting in coarse grains. Thus, grain boundary sliding is suppressed by the coarse grains, and deformation resistance increases. If the Mn content in the aluminum alloy is less than the above-described range, the above-described effect is not sufficiently obtained and the deformation resistance decreases. If the Mn content exceeds the above-described range, coarse intermetallic compounds are formed during casting, causing manufactural problems.

In addition to Si, Fe, and Mn, the aluminum alloy for the aluminum alloy sheet according to the present invention may further comprise any one or two or more among Mg, Cu, Ni, Cr, Zr, Ti, V, Be, Sr, Bi, Na, Ca, Zn, In, Sn, and rare earth elements as the optional additive elements if necessary.

After the heat joining, Mg forms $Mg_2Si$, which causes age hardening and increases the strength. Thus, Mg is an additive element that has a strength-increasing effect. When the aluminum alloy for the aluminum alloy sheet according to the present invention comprises Mg, the Mg content in the aluminum alloy for the aluminum alloy sheet according to the present invention is 3.00 mass % or less, preferably 0.05 to 3.00 mass %. When the Mg content in the aluminum alloy is within this range, the strength is higher. If the Mg content in the aluminum alloy exceeds this range, Mg reacts with flux to form a high-melting compound, which significantly reduces the joining performance. In the present invention, as for Mg or not only Mg but also other chemical compositions, a content that is a predetermined content or less includes a content of 0 mass %.

Cu is an additive element that dissolves into the matrix in a solid state to increase the strength. When the aluminum alloy for the aluminum alloy sheet according to the present invention comprises Cu, the Cu content in the aluminum alloy for the aluminum alloy sheet according to the present invention is 1.50% or less by mass, preferably 0.05 to 1.50 mass %. When the Cu content in the aluminum alloy is within this range, the strength is higher. If the Cu content in the aluminum alloy exceeds this range, the corrosion resistance decreases.

Ni crystallizes or precipitates as an intermetallic compound and has the effect of increasing the strength after heat joining by dispersion strengthening. When the aluminum alloy for the aluminum alloy sheet according to the present invention comprises Ni, the Ni content in the aluminum alloy for the aluminum alloy sheet according to the present invention is 2.00 mass % or less, preferably 0.05 to 2.00 mass %. When the Ni content in the aluminum alloy is within this range, the strength is higher. If the Ni content in the aluminum alloy exceeds this range, coarse intermetallic compounds are easily formed, resulting in low workability and low self-corrosion resistance.

Cr increases the strength by solid-solution strengthening, and also precipitates Al—Cr-based intermetallic compounds, which act to coarsen grains after heating. When the aluminum alloy for the aluminum alloy sheet according to the present invention comprises Cr, the Cr content in the aluminum alloy for the aluminum alloy sheet according to the present invention is 0.30 mass % or less, preferably 0.05 to 0.30 mass %. When the Cr content in the aluminum alloy is within this range, the strength is higher. If the Cr content in the aluminum alloy exceeds this range, coarse intermetallic compounds are easily formed and plastic workability decreases.

Zr precipitates as an Al—Zr-based intermetallic compound and has the effect of increasing the strength after heat joining by dispersion strengthening. When the aluminum alloy for the aluminum alloy sheet according to the present invention comprises Zr, the Zr content in the aluminum alloy for the aluminum alloy sheet according to the present invention is 0.30 mass % or less, preferably 0.05 to 0.30 mass %. When the Zr content in the aluminum alloy is within this range, the strength is higher. If the Zr content in the aluminum alloy exceeds this range, coarse intermetallic compounds are easily formed and plastic workability decreases.

Ti and V have the effects of increasing the strength by dissolving into the matrix in a solid state, and also preventing the propagation of corrosion in the sheet thickness direction by being distributed in layers. When the aluminum alloy for the aluminum alloy sheet according to the present invention comprises Ti, the Ti content in the aluminum alloy for the aluminum alloy sheet according to the present invention is 0.30% or less, preferably 0.05 to 0.30 mass %. When the aluminum alloy comprises V, the V content in the aluminum alloy for the aluminum alloy sheet according to the present invention is 0.30 mass % or less, preferably 0.05 to 0.30 mass %. When the Ti content or the V content in the aluminum alloy is within this range, the strength is higher and the propagation of corrosion in the sheet thickness direction can be prevented. If the Ti content or the V content in the aluminum alloy exceeds this range, giant crystallized substances are formed, which degrade formability and corrosion resistance.

Zn is an effective element for increasing corrosion resistance due to the sacrificial anti-corrosion action. Zn has the effect of setting the natural potential less-noble by almost uniformly dissolving into the matrix in a solid state. For example, when the aluminum alloy material according to the present invention is used for a fin material, by setting the potential thereof less-noble, the sacrificial anti-corrosion action for relatively inhibiting the corrosion of a tube joined to the fin can be exerted. When the aluminum alloy for the aluminum alloy sheet according to the present invention comprises Zn, the Zn content in the aluminum alloy for the aluminum alloy sheet according to the present invention is 6.00 mass % or less, preferably 0.05 to 6.00 mass %, and particularly preferably 0.10 to 5.00 mass %. When the Zn content in the aluminum alloy is within this range, the corrosion resistance is higher. If the Zn content in the aluminum alloy exceeds this range, the corrosion rate excessively increases, resulting in low self-corrosion resistance and low sacrificial anti-corrosion action.

Be, Sr, Bi, Na, and Ca can increase the joining performance by finely dispersing Si particles and increasing the fluidity of the liquid phase, for example. When the aluminum alloy for the aluminum alloy sheet according to the present invention comprises Be, the Be content in the aluminum alloy for the aluminum alloy sheet according to the present invention is 0.10 mass % or less, preferably 0.0001 to 0.10 mass %. When the aluminum alloy for the aluminum alloy sheet according to the present invention comprises Sr, the Sr content in the aluminum alloy for the aluminum alloy sheet according to the present invention is 0.10 mass % or less, preferably 0.0001 to 0.10 mass %. When the aluminum alloy for the aluminum alloy sheet according to the present invention comprises Bi, the Bi content in the aluminum alloy for the aluminum alloy sheet according to the present invention is 0.30 mass % or less, preferably 0.0001 to 0.30 mass %. When the aluminum alloy for the aluminum alloy sheet according to the present invention comprises Na, the Na content in the aluminum alloy for the aluminum alloy sheet according to the present invention is 0.10 mass % or less, preferably 0.0001 to 0.10 mass %. When the aluminum alloy for the aluminum alloy sheet according to the present invention comprises Ca, the Ca content in the aluminum alloy for the aluminum alloy sheet according to the present invention is 0.05 mass % or less, preferably 0.0001 to 0.05 mass %. When the Be content, the Sr content, the Bi content, the Na content, or the Ca content in the aluminum alloy is within the above-described corresponding range, the joining performance is higher. If the Be content, the Sr content, the Bi content, the Na content, or the Ca content in the aluminum alloy exceeds the above-described range, adverse effects such as reduction of corrosion resistance may occur. When the aluminum alloy comprises one or two or more among Be, Sr, Bi, Na, and Ca, the respective additive elements all need to be within the above-described composition ranges. The aluminum alloy for the aluminum alloy sheet according to the present invention may also comprise In of 0.10 mass % or less, Sn of 0.10 mass % or less, and rare earth elements of 0.10 mass % or less.

In a heating test in which the temperature of the aluminum alloy sheet according to the present invention is raised from 300° C. to 400° C. at an average temperature rising rate of 60° C./min or less and held at 600±3° C. for 5±3 minutes, which is a heating test in which the temperature is preferably raised from 300° C. to 400° C. at an average temperature rising rate of 60° C./min or less, preferably raised at 45° C./min or less, raised from 400° C. to 580° C. in 8±3 minutes, raised from 580° C. to the holding temperature in 8±3 minutes, and held at 600±3° C. for 5±3 minutes, the average grain size in a plane parallel to a rolled surface after the heating test is 370 μm or more, preferably 370 to 1500 μm, particularly preferably 400 to 1500 μm, and the average number of grains in the sheet thickness direction after the heating test is 1.5 pieces or more, preferably 1.5 to 10.0 pieces. In other words, the aluminum alloy sheet according to the present invention has such a metal structure that, by heating in which the temperature is raised from 300° C. to 400° C. at an average temperature rising rate of 60° C./min or less and held at 600±3° C. for 5±3 minutes, which is heating in which the temperature is preferably raised from 300° C. to 400° C. at an average temperature rising rate of 60° C./min or less, preferably raised at 45° C./min or less, raised from 400° C. to 580° C. in 8±3 minutes, raised from 580° C. to the holding temperature in 8±3 minutes, and held at 600±3° C. for 5±3 minutes, the average grain size in a plane parallel to a rolled surface after the heating test is 370 μm or more, preferably 370 to 1500 μm, particularly preferably 400 to 1500 μm, and the average number of grains in the sheet thickness direction after the heating test is 1.5 pieces or more, preferably 1.5 to 10.0 pieces. The inventors have found that the material of the aluminum alloy sheet having such a metal structure that, by heating in which the temperature is raised from 300° C. to 400° C. at an average temperature rising rate of 60° C./min or less and held at 600±3° C. for 5±3 minutes, which is heating in which the temperature is preferably raised from 300° C. to 400° C. at an average temperature rising rate of 60° C./min or less, preferably raised at 45° C./min or less, raised from 400° C. to 580° C. in 8±3 minutes, raised from 580° C. to the holding temperature in 8±3 minutes, and held at 600±3° C. for 5±3 minutes, the average grain size in a plane parallel to a rolled surface and the average number of grains in the sheet thickness direction fall within the above-described ranges is less likely to deform during heating in heat joining in a single layer.

In the heating test in which the temperature of the aluminum alloy sheet according to the present invention is raised from 300° C. to 400° C. at an average temperature rising rate of 60° C./min or less and held at 600±3° C. for 5±3 minutes, which is the heating test in which the temperature is preferably raised from 300° C. to 400° C. at an average temperature rising rate of 60° C./min or less, preferably 45° C./min or less, raised from 400° C. to 580° C.

in 8±3 minutes, raised from 580° C. to the holding temperature in 8±3 minutes, and held at 600±3° C. for 5±3 minutes, the average grain size in a plane parallel to a rolled surface after the heating test is 370 μm or more, preferably 370 to 1500 μm, particularly preferably 400 to 1500 μm. In an aluminum alloy sheet having the function of heat joining in a single layer, grain boundary portions are melted during heating for the heat joining, and thus when grains are small, the grains are easily displaced from each other at grain boundaries, which causes deformation. Thus, in such an aluminum alloy sheet that, in the heating test in which the temperature is raised from 300° C. to 400° C. at an average temperature rising rate of 60° C./min or less and held at 600±3° C. for 5±3 minutes, which is the heating test in which the temperature is preferably raised from 300° C. to 400° C. at an average temperature rising rate of 60° C./min or less, preferably 45° C./min or less, raised from 400° C. to 580° C. in 8±3 minutes, raised from 580° C. to the holding temperature in 8±3 minutes, and held at 600±3° C. for 5±3 minutes, the average grain size in a plane parallel to a rolled surface after the heating test falls within the above-described range, grains are less likely to be displaced from each other during heat joining. Thus, the deformation resistance during heat joining is higher. Herein, the average grain size is determined after heating because it is very difficult to observe the average grain during the heating. The upper limit of the above-described average grain size is not limited to a particular value. However, the upper limit of the above-described average grain size is about 1500 μm, which depends on conditions for manufacturing the aluminum alloy material and heating conditions during heat joining.

In the present invention, the average grain size in a plane parallel to a rolled surface is determined by observing a sample that has been mirror polished and then etched by an anodic oxidation method under an optical microscope to obtain a grain structure observation image, and then measuring the average grain size by the area measurement method. The area measurement method herein is a method of calculating the average grain size d by drawing a rectangular parallelepiped of a certain size on the grain structure observation image, counting each of grains encompassed by the rectangular parallelepiped as 1 and each of grains cut by the sides of each rectangle as 0.5, measuring the number of grains within the rectangle and on the rectangle, and using the following formula (1).

$$\text{Average grain size } d\ (\mu m) = ((\text{Total evaluated area } (\mu m^2)/\text{Total number of grains (pcs)}))^{0.5} \quad (1)$$

In the present invention, the plane parallel to a rolled surface is a plane perpendicular to the sheet thickness direction.

In the heating test in which the temperature of the aluminum alloy sheet according to the present invention is raised from 300° C. to 400° C. at an average temperature rising rate of 60° C./min or less and held at 600±3° C. for 5±3 minutes, which is the heating test in which the temperature is preferably raised from 300° C. to 400° C. at an average temperature rising rate of 60° C./min or less, preferably 45° C./min or less, raised from 400° C. to 580° C. in 8±3 minutes, raised from 580° C. to the holding temperature in 8±3 minutes, and held at 600±3° C. for 5±3 minutes, the average number of grains in the sheet thickness direction after the heating test is 1.5 pieces or more, preferably 1.5 to 10.0 pieces. In aluminum alloy sheet, the greater the number of grains in the sheet thickness direction during heating for heat joining, the more the grain boundary sliding caused by heating is prevented from propagating in the sheet thickness direction, and the less likely the material is deformed during joining. Thus, in such an aluminum alloy sheet that, in the heating test in which the temperature is raised from 300° C. to 400° C. at an average temperature rising rate of 60° C./min or less and held at 600±3° C. for 5±3 minutes, which is the heating test in which the temperature is preferably raised from 300° C. to 400° C. at an average temperature rising rate of 60° C./min or less, preferably 45° C./min or less, raised from 400° C. to 580° C. in 8±3 minutes, raised from 580° C. to the holding temperature in 8±3 minutes, and held at 600±3° C. for 5±3 minutes, the average number of grains in the sheet thickness direction after the heating test falls within the above-described range, the propagation of the grain boundary sliding in the sheet thickness direction during heat joining is prevented. Thus, the deformation resistance during heat joining can be increased. Herein, the average number of grains is determined after heating because it is very difficult to observe grains during the heating. The upper limit of the above-described average number of grains is not limited to a particular value. However, the upper limit of the above-described average number of grains is 10.0 pieces, which depends on conditions of manufacturing the aluminum alloy material and heating conditions during heat joining.

Figure 5:
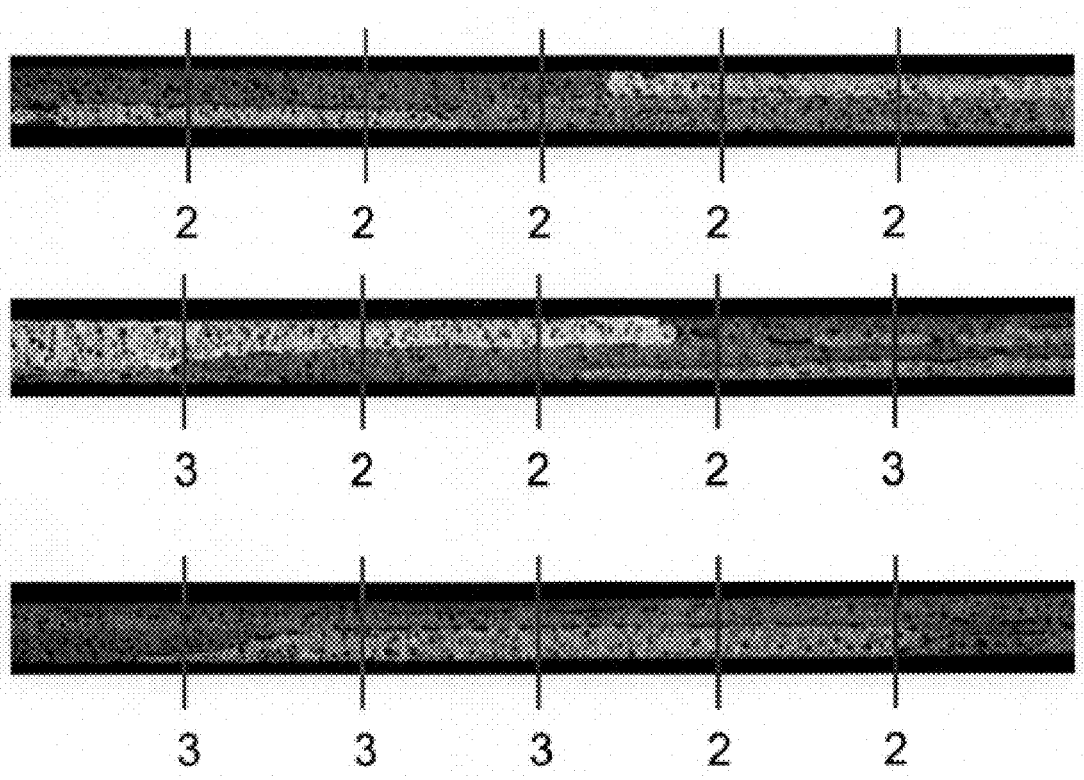
FIG. 5 is a diagram for describing a method of measuring the average number of grains in the sheet thickness direction after a heating test.

In the present invention, the average number of grains in the sheet thickness direction is obtained by, as illustrated in FIG. 5, observing the cross section of an aluminum alloy sheet after a heating test under an optical microscope with a field of view of 2000 μm or more to obtain a grain structure observation image, then drawing cutting-plane lines through the sheet thickness at intervals of 200 μm, measuring the numbers of grains present on the cutting-plane lines, and averaging the numbers. For example, in the example illustrated in FIG. 5, 15 cutting-plane lines are drawn through the sheet thickness at intervals of 200 μm, and the total number of grains present on all these cutting-plane lines is 34 pieces. Thus, the average number of grains in the sheet thickness direction is 34/15=2.3 pieces. FIG. 5 is an image of three different cross sections of the aluminum alloy sheet after the heating test, observed with the optical microscope.

In the heating test in the present invention in which the temperature is raised from 300° C. to 400° C. at an average rate of 60° C./min or less and held at 600±3° C. for 5±3 minutes, which is the heating test in which the temperature is preferably raised from 300° C. to 400° C. at an average rate of 60° C./min or less, preferably 45° C./min or less, raised from 400° C. to 580° C. in 8±3 minutes, raised from 580° C. to the holding temperature in 8±3 minutes, and held at 600±3° C. for 5±3 minutes, a test sample of the aluminum alloy sheet according to the present invention is heated in an atmosphere of inert gas first to raise the temperature thereof up to a holding temperature of 600±3° C., and then held at 600±3° C. for 5±3 minutes. Subsequently, a heating test of cooling it to a room temperature is performed, and then the average grain size of the test sample after the heating test in a plane parallel to a rolled surface and the average number of grains thereof in the sheet thickness direction are measured. The temperature rise conditions for the heating test are conditions in which the temperature is raised from 300° C. to 400° C. at an average temperature rising rate of 60° C./min or less and then raised up to 600° C., which are conditions in which the temperature is preferably raised from 300° C. to 400° C. at an average rate of 60° C./min or less, preferably 45° C./min or less, raised from 400° C. to 580° C. in 8±3 minutes, and raised from 580° C. to the holding temperature in 8±3 minutes.

The thickness of the aluminum alloy sheet according to the present invention is preferably 0.30 mm or less. The preferable sheet thickness for a fin material of a heat exchanger is 0.30 mm or less. The aluminum alloy sheet according to the present invention has excellent deformation resistance even when the sheet thickness is as small as 0.30 mm or less.

The aluminum alloy sheet according to the present invention is an aluminum alloy sheet having the function of heat joining in a single layer at a temperature at which the liquid phase ratio is 5.0% or more and 35.0% or less (aluminum alloy sheet having a single-layer heat joining function). In other words, the aluminum alloy sheet according to the present invention is a single-layer brazing sheet.

The following describes the aluminum alloy sheet having the function of heat joining in a single layer (hereinafter, also referred to as "single-layer brazing sheet") at a temperature at which the liquid phase ratio is 5.0% or more and 35.0% or less. The single-layer brazing sheet needs to be joined at a temperature at which the ratio of the mass of the liquid phase formed in the aluminum alloy material to the total mass of the aluminum alloy material (hereinafter, referred to as "liquid phase ratio") is 5% or more and 35% or less. If the liquid phase ratio exceeds 35%, the amount of the liquid phase formed is so large that the aluminum alloy material cannot maintain its shape, resulting in large deformation. If the liquid phase ratio is less than 5%, the joining becomes difficult. The liquid phase ratio is preferably 5 to 30%, and the liquid phase ratio is more preferably 10 to 20%.

The mechanism of formation of the liquid phase will be described. FIG. 1 schematically illustrates a phase diagram of an Al—Si alloy that is a typical binary-phase eutectic alloy. When an aluminum alloy material having a Si concentration of c1 is heated, a liquid phase starts to be formed at a temperature T1 near but above a eutectic temperature (solidus temperature) Te. At the eutectic temperature Te or less, crystalline precipitates are distributed in a matrix partitioned by grain boundaries, as illustrated in FIG. 2(*a*). When the liquid phase starts to be formed in this state, the grain boundaries in which the crystalline precipitates are distributed in larger amount due to segregation are melted to form liquid phases, as illustrated in FIG. 2(*b*). Subsequently, as illustrated in FIG. 2(*c*), the surroundings of crystalline precipitate particles and intermetallic compounds of Si, which is a main additive element composition dispersed in the matrix of the aluminum alloy, are melted in spherical shapes to form liquid phases. Furthermore, as illustrated in FIG. 2(*d*), these spherical liquid phases formed in the matrix dissolves again into the matrix in a solid state due to interface energy with the lapse of time or a rise of temperature, and move to the grain boundaries or surfaces by diffusion in the solid phase. Subsequently, when the temperature rises to T2 as illustrated in FIG. 1, the amount of liquid phases increases in the phase diagram. As illustrated in FIG. 1, if the Si concentration of the aluminum alloy material is c2, which is less than the maximum solid-solubility limit concentration, a liquid phase starts to be formed near but above a solidus temperature Ts2. However, unlike the case of c1, in the structure immediately before melting, crystalline precipitates do not always exist in the matrix as illustrated in FIG. 3(*a*). In this case, the grain boundaries are first melted to form liquid phases as illustrated in FIG. 3(*b*), and then a liquid phase starts to be formed in a location where the concentration of solute elements is locally high in the matrix as illustrated in FIG. 3(*c*). As illustrated in FIG. 3(*d*), these spherical liquid phases formed in the matrix dissolve again into the matrix in a solid state due to interface energy with the lapse of time or a rise of temperature, and move to the grain boundaries or surfaces by diffusion in the solid phase, in the same manner as in the case of cl. When the temperature rises to T3, the amount of the liquid phases increases more than that illustrated in the phase diagram. Thus, the joining in the present invention utilizes the liquid phase formed by local melting inside the single-layer brazing sheet (the fin material for a heat exchanger according to the present invention), which can achieve both the joining and shape keeping.

A behavior of the metal structure from the formation of a liquid phase to the joining will be described. A single-layer brazing sheet that forms a liquid phase and an aluminum alloy opposing material to be joined to this sheet are combined, and these are heated at a temperature in which the liquid phase ratio is 5.0% or more and 35.0% or less. When a joint is observed with a microscope, a very small amount of liquid phase, which is formed on a surface of the single-layer brazing sheet during joining as described above, fills a clearance between the sheet and the aluminum alloy opposing material with an oxide coating that has been broken by the action of flux, for example. Subsequently, the liquid phase near the joining interface between both alloy materials moves into the aluminum alloy opposing material, and grains of the solid phase a-phase in the single-layer brazing sheet being in contact with the joining interface accordingly grow toward inside of the aluminum alloy opposing material. Meanwhile, grains in the aluminum alloy opposing material also grow toward the single-layer brazing sheet. A structure in which the structure of the single-layer brazing sheet is embedded in the aluminum alloy opposing material near the joining interface is formed for the joining. Thus, a metal structure other than that of the single-layer brazing sheet and the aluminum alloy opposing material is not formed at the joining interface.

In contrast, when a brazing sheet on which a brazing filler metal has been clad is used and joined to an aluminum alloy opposing material by brazing heating, a fillet is formed in a joint and a eutectic structure appears. Thus, a joining structure different from that of the case in which the single-layer brazing sheet is used and joined to an aluminum alloy opposing material by brazing heating is formed. In other words, when a brazing sheet on which a brazing filler metal has been clad is used and joined to an aluminum alloy opposing material by brazing heating, the liquid-phase brazing filler metal fills the joint to form a fillet. Thus, a eutectic structure different from the surroundings is formed in the joint. Also in the welding method, the joined portion melts locally, resulting in a metal structure that is different from that of other areas.

Thus, when the single-layer brazing sheet is used to be heat joined to an aluminum alloy opposing material, the joining structure is different from that of the case using a brazing sheet on which a brazing filler metal has been clad and the case of welding, in that the metal structure of the joined portion consists of both materials to be joined, or includes a material into which both materials to be joined are integrated.

Because of this joining behavior, when a single-layer brazing sheet is used to be heat joined to an aluminum alloy opposing material, almost no change in shape occurs near the joined area after the joining process. In other words, shape changes after joining, such as beads in welding and fillets in brazing, hardly occur when the single-layer brazing sheet is used to be heat joined to an aluminum alloy opposing material. Nevertheless, joining can be achieved by metal joining as well as welding and brazing. For example, when a drawn cup-type stacked type heat exchanger is assembled using a brazing sheet clad with a brazing filler metal (the brazing clad ratio is 5% on each side), the height of the stacked type heat exchanger decreases by 5 to 10% after brazing heating because the molten brazing filler metal gathers at the joined portion. Thus, this decrease needs to be taken into account in product design. In contrast, when a single-layer brazing sheet is used to be heat joined to an aluminum alloy opposing material, dimensional changes after the joining are very small, which enables high-precision product design.

In the present invention, it is very difficult to measure the actual liquid phase ratio during heating of the single-layer brazing sheet. Thus, the liquid phase ratio specified in the present invention is determined by equilibrium calculation. Specifically, it is calculated based on the chemical composition and the maximum reached temperature during heating by using thermodynamic equilibrium calculation software such as Thermo-Calc (registered trademark) made by Thermo-Calc Software AB.

Figure 4:
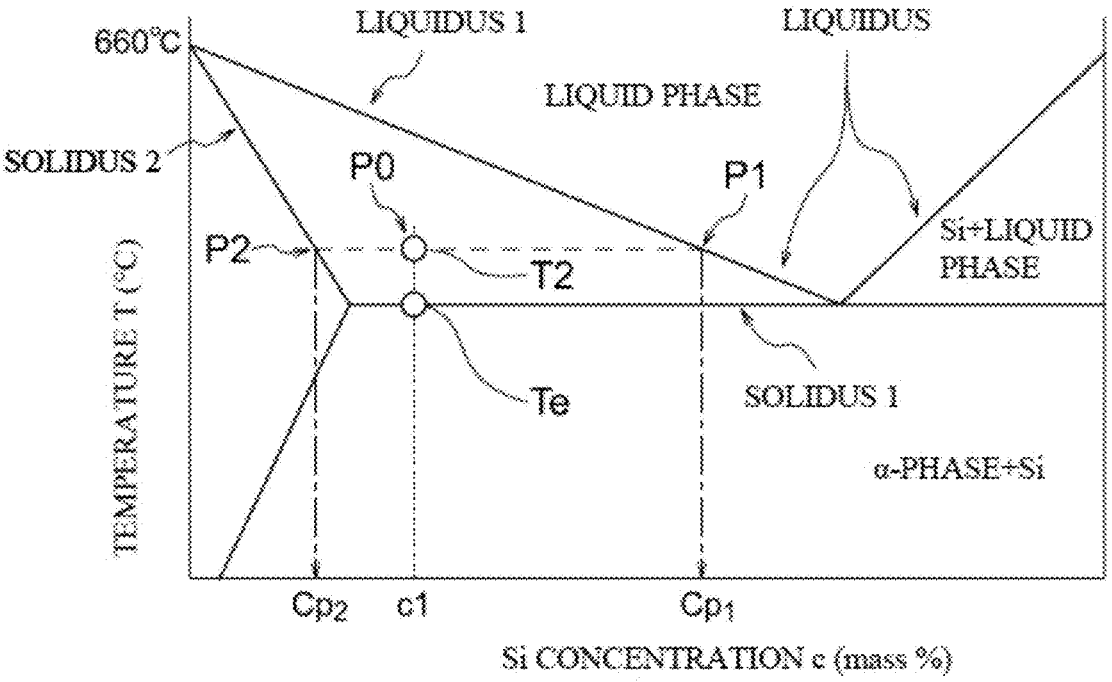
FIG. 4 is a schematic phase diagram of an Al—Si alloy that is a typical binary-phase eutectic alloy.

The relation between the liquid phase ratio and the temperature will be described with reference to the phase diagram illustrated in FIG. 4. FIG. 4 is a modified diagram of FIG. 1. In FIG. 4, a line extending parallel to the horizontal axis through the temperature Te (hereinafter, referred to as "solidus 1") and a line extending toward the upper left from the left end of solidus 1 to 660° C. on the vertical axis while delineating a boundary with the a-phase (hereinafter, referred to as "solidus 2") both represent solidi. A line extending toward the lower right from 660° C. on the vertical axis and being in contact with the solidus 1 (hereinafter, referred to as "liquidus 1") and a line extending toward the upper right from this contact position while delineating a boundary with (Si+liquid phase) both represent liquidi.

It is assumed here that P0 is a point at a temperature T2, a line parallel to the horizontal axis of the diagram is drawn through P0, P1 is an intersection with the liquidus 1, and P2 is an intersection with the solidus 2. An Al—Si alloy having a Si concentration of Cl is in a state in which the liquid phase and the solid phase coexist at the temperature T2, and the Si concentration in the liquid phase is a concentration $C_{P1}$ at the point P1, and the Si concentration in the solid phase is a concentration $C_{P2}$ at the point P2. The ratio of the mass of the liquid phase to the total mass at the temperature T2, that is, the liquid phase ratio is a ratio of the length of a line segment P0 to P2 to the length of a line segment P1 to P2.

As described above, based on the phase diagrams of a binary-phase alloy as illustrated in FIG. 1 and FIG. 4, the liquid phase ratio is obtained by drawing from the chemical composition and temperature. Similarly, even in a ternary or more multicomponent system, the liquid phase ratio can be obtained for the ternary or more multicomponent system by drawing from the chemical composition and temperature based on a phase diagram. Although it is difficult to represent a phase diagram of a ternary or more multicomponent system as a simple X-Y plane diagram as illustrated in FIG. 4, the liquid phase ratio can be obtained by computer calculation using Thermo-Calc's thermodynamic equilibrium calculation software.

The aluminum alloy sheet according to the present invention may be manufactured by any manufacturing method. For example, the aluminum alloy sheet according to the present invention is preferably manufactured by a method for manufacturing an aluminum alloy sheet according to the present invention described below.

The method for manufacturing an aluminum alloy sheet according to the present invention is a method for manufacturing an aluminum alloy sheet, the method comprising:

a casting step of casting a cast-rolled sheet of an aluminum alloy comprising Si of 1.50 to 5.00 mass %, Fe of 0.01 to 2.00 mass %, and Mn of 0.50 to 2.00 mass %, with the balance being Al and inevitable impurities by continuous casting rolling; and a cold-rolling step of cold rolling the cast-rolled sheet two or more times, wherein annealing is performed one or more times between after the casting step and before a final cold rolling at the cold-rolling step, and annealing conditions for all annealings are set such that an annealing temperature is 200 to 550° C. and an annealing time is 1 to 10 hours.

The method for manufacturing an aluminum alloy sheet according to the present invention comprises at least the casting step, the cold-rolling step, and the annealing. The casting step is a step of casting the cast-rolled sheet of the aluminum alloy having a predetermined chemical composition by the continuous casting rolling. In a continuous casting method, the cooling rate during solidification is fast, and thus coarse crystals are less likely to be formed and the formation of Si-based intermetallic compounds having equivalent diameters of 5.0 to 10 μm is suppressed. As a result, the number of recrystallized nuclei can be reduced, and thus only certain grains grow and coarse grains can be obtained. Furthermore, in the continuous casting method, difference in cooling rate in the width direction is smaller and increase in concentration due to discharge of solute atoms easily becomes more uniform in the width direction than in a Direct Chill (DC) casting method of water-cooling an ingot having a large thickness, and thus the quality of the aluminum alloy material is stable. The continuous casting method is not limited to a particular one insofar as the method can continuously cast a plate ingot like twin-roll continuous casting rolling or twin-belt continuous casting. The twin-roll continuous casting rolling is a method of supplying molten aluminum to between a pair of water-cooled rolls from a molten metal nozzle made of a refractory, thereby continuously casing and rolling a thin plate, and the Hunter process, the 3C process, and the like are known as examples thereof. The twin-belt continuous casing method is a continuous casing method of feeding a molten metal to between water-cooled rotating belts that are vertically opposed, solidifying the molten metal into a slab under cooling from belt surfaces, continuously pulling out the slab from a side of the belts opposite to the molten-metal feeding side, and winding the slab into a coiled form. In the twin-roll continuous casting rolling, the cooling rate during the casting is as high as several times to several hundred times that in a semi-continuous casting method. For example, the cooling rate in the semi-continuous casting method is 0.5 to 20° C./s, while the cooling rate in the twin-roll continuous casting rolling is 100 to 1000° C./s. Thus, the twin-roll continuous casting rolling is characterized in that dispersed particles formed during the casting are more finely distributed with higher density than in the semi-continuous casting method. This suppresses the formation of coarse crystallites, resulting in coarser grains during heating for joining. This high cooling rate also allows the amount of additive elements dissolving in a solid state to be increased. Thus, fine precipitates are formed by subsequent heat treatment, which can contribute to grain coarsening during the heating for joining.

At the casting step, the cooling rate for casting by the twin-roll continuous casting rolling is preferably 100 to 1000° C./s. If the cooling rate is less than 100° C./s, it is difficult to obtain a desired metal structure, and if it exceeds 1000° C./s, stable manufacture is difficult. The speed of the rolled sheet for casting by the twin-roll continuous casting rolling is preferably 0.3 to 3 m/min. The casting speed exerts an influence on the cooling rate. If the casting speed is less than 0.3 m/min, the compound becomes coarse because the cooling rate is not sufficient as described above. If it exceeds 3 m/min, the aluminum material does not solidify sufficiently between the rolls during casting, and a normal plate ingot cannot be obtained. The temperature of the molten metal for the casting by the twin-roll continuous casting rolling method is preferably 650 to 800° C., more preferably 680 to 750° C. The temperature of the molten metal is a temperature of a head box disposed immediately upstream of the molten-metal feed nozzle. If the temperature of the molten metal is less than the above-described range, dispersed particles of coarse intermetallic compounds are formed in the molten-metal feed nozzle, and these particles get mixed into the ingot, thereby causing sheet breakage during cold rolling. If the temperature of the molten metal exceeds the above-described range, the aluminum material does not solidify sufficiently between the rolls during the casting, and a normal plate ingot cannot be obtained.

The thickness of the plate ingot to be cast by the twin-roll continuous casting rolling is preferably 2 to 10 mm, particularly preferably 4 to 8 mm. In this thickness range, the solidification rate in the center of the plate thickness is also fast, and a uniform structure can be easily obtained. If the thickness is less than this range, the amount of aluminum passing through a casting machine per unit time is small, which makes it difficult to stably feed the molten metal in the plate width direction. If the thickness exceeds this range, winding by the rolls is difficult.

At the casting step, the cast-rolled sheet formed of an aluminum alloy comprising: Si of 1.50 to 5.00 mass %, preferably 1.60 to 3.50 mass %, more preferably 2.00 to 3.00 mass %; Fe of 0.01 to 2.00 mass %, preferably 0.20 to 1.00 mass %; and Mn of 0.50 to 2.00 mass %, preferably 0.80 to 1.50 mass %, with the balance being Al and inevitable impurities is cast. The cast-rolled sheet obtained by performing the casting step may further comprise, if necessary, as optional additive elements, any one or two or more among: Zn of 6.00 mass % or less, preferably 0.05 to 6.00 mass %, particularly preferably 0.10 to 5.00 mass %; Mg of 3.00 mass % or less, preferably 0.05 to 3.00 mass %; Cu of 1.50 mass % or less, preferably 0.05 to 1.50 mass %; Ni of 2.00 mass % or less, preferably 0.05 to 2.00 mass %; Cr of 0.30 mass % or less, preferably 0.05 to 0.30 mass %; Zr of 0.30 mass % or less, preferably 0.05 to 0.30 mass %; Ti of 0.30 mass % or less, preferably 0.05 to 0.30 mass %; V of 0.30 mass % or less, preferably 0.05 to 0.30 mass %; Be of 0.10 mass % or less, preferably 0.0001 to 0.10 mass %; Sr of 0.10 mass % or less, preferably 0.0001 to 0.10 mass %; Bi of 0.30% or less, preferably 0.0001 to 0.30 mass %; Na of 0.10 mass % or less, preferably 0.0001 to 0.10 mass %; and Ca of 0.05 mass % or less, preferably 0.0001 to 0.05 mass %. The cast-rolled sheet obtained by performing the casting step may comprise In of 0.10 mass % or less, Sn of 0.10 mass % or less, and rare earth elements of 0.10 mass % or less of as optional additive elements, if necessary. At the casting step, the molten metal of the aluminum alloy having the above-described chemical composition is prepared, and the continuous casting rolling is performed using the molten metal, whereby the chemical composition of the cast-rolled sheet can be set to the above-described chemical composition.

The cold-rolling step is a step of cold rolling the cast the cast-rolled sheet obtained by performing the casting step. At the cold-rolling step, the cold rolling is performed two or more times. In other words, at the cold-rolling step, a cold-rolling pass is performed two or more times. The number of cold rollings at the cold-rolling step is selected as appropriate. At the cold-rolling step, the aluminum alloy sheet is cold rolled until the thickness of a final sheet is obtained. In other words, the thickness of the aluminum alloy sheet after the final cold rolling at the cold-rolling step is the thickness of the final sheet.

In the method for manufacturing an aluminum alloy sheet according to the present invention, annealing is performed one or more times between after the casting step and before the final cold rolling at the cold-rolling step. In the method for manufacturing an aluminum alloy sheet according to the present invention, the timing for performing the annealing includes timings: (1) after performing the casting step and before performing the cold-rolling step; and (2) between a cold rolling and a cold rolling when cold rolling is performed two or more times at the cold-rolling step. In either or both of (1) and (2), one or more times, preferably one to three times, more preferably one to two times, annealing is performed. When cold rolling is performed three or more times at the cold-rolling step, there are two or more intervals between cold rollings, and in such cases, annealing may be performed two or more times at the cold-rolling step. The annealing is performed to soften the aluminum alloy sheet to facilitate obtaining the desired strength in the final cold rolling. This annealing can optimally adjust the size and density of intermetallic compounds in the aluminum alloy sheet and the amount of additive elements dissolving therein in a solid state. In the method for manufacturing an aluminum alloy sheet according to the present invention, no annealing is performed after the last cold rolling at the cold-rolling step has been performed.

As the annealing conditions in the annealing, the annealing temperature is 200 to 550° C., preferably 250 to 450° C., and the annealing time is 1 to 10 hours. In other words, the annealing involves heating at an annealing temperature of 200 to 550° C., preferably 250 to 450° C., for an annealing time of 1 to 10 hours. If the annealing temperature is less than this range, the aluminum alloy sheet is not sufficiently softened, resulting in high tensile strength before heat joining. High tensile strength before heat joining results in poor formability, which deteriorates core dimensions, and consequently durability decreases. If the annealing temperature exceeds the above-described range, annealing is performed at an excessive temperature above the softening temperature of the aluminum alloy sheet, which is economically disadvantageous.

In the method for manufacturing an aluminum alloy sheet according to the present invention, the total reduction of cold rolling to be performed after the last annealing has been performed is preferably 20 to 50%, and particularly preferably 25 to 40%. When the total reduction of the cold rolling to be performed after the last annealing has been performed is within this range, it is easy to obtain the aluminum alloy sheet having "such a metal structure that, in a heating test in which the temperature is raised from 300° C. to 400° C. at an average temperature rising rate of 60° C./min or less and held at 600±3° C. for 5±3 minutes, which is a heating test in which the temperature is preferably raised from 300° C. to 400° C. at an average temperature rising rate of 60° C./min or less, preferably raised at 45° C./min or less, raised from 400° C. to 580° C. in 8±3 minutes, raised from 580° C. to the holding temperature in 8±3 minutes, and held at 600±3° C. for 5±3 minutes, the average grain size in a plane parallel to a rolled surface after the heating test is 370 μm or more, preferably 370 to 1500 μm, particularly preferably 400 to 1500 μm, and the average number of grains in the sheet thickness direction after the heating test is 1.5 pieces or more, preferably 1.5 to 10.0 pieces". In the present invention, when annealing is performed only once, the last annealing refers to this one annealing, and when annealing is performed two or more times, it refers to the annealing that is performed at the very end among these two or more annealings. The total reduction A (%) of the cold rolling to be performed after the last annealing has been performed is a value calculated by the following formula.

$$A\ (\%)=((B-C)/B)\times 100$$

A: Total reduction (%) of cold rolling to be performed after the last annealing has been performed B: Thickness of the rolled sheet immediately after the last annealing has been performed C: Thickness of the rolled sheet after the last cold rolling has been performed When only one cold rolling is performed after the last annealing has been performed, the thickness of the rolled sheet before this cold rolling is B, and the thickness of the rolled sheet after the cold rolling is C. When a plurality of cold rollings are performed after the last annealing has been performed, the thickness of the rolled sheet before the first cold rolling among the cold rollings after the last annealing has been performed is B, and the thickness of the rolled sheet after the last cold rolling is C.

The temper of the aluminum alloy sheet obtained by performing the method for manufacturing an aluminum alloy sheet according to the present invention may be 0 material or may be H material. When the aluminum alloy sheet is to be H1n material or H2n material, the final cold-rolling ratio is 50% or less, preferably 5 to 50%. If the final cold-rolling ratio exceeds 50%, many recrystallized nuclei are formed during heating, resulting in finer grain size after heating for joining. If the final cold-rolling ratio is less than 5%, manufacture may be substantially difficult.

The aluminum alloy sheet obtained by performing the method for manufacturing an aluminum alloy sheet according to the present invention has the function of heat joining in a single layer at a temperature at which the liquid phase ratio is 5.0% or more and 35.0% or less.

In the method for manufacturing an aluminum alloy sheet according to the present invention, a cast-rolled sheet is cast at the casting step by continuous casting rolling, preferably by the twin-roll continuous casting rolling, annealing is performed one or more times between after the casting step and obtaining of the final sheet, and the annealing conditions in all annealings are set such that the annealing temperature is 200 to 550° C., preferably 250 to 450° C., and the annealing time is 1 to 10 hours, and preferably the total reduction in the cold rolling after the last annealing is 20 to 50%, preferably 25 to 40%. This enables manufacture of the aluminum alloy sheet having "such a metal structure that, in a heating test in which the temperature is raised from 300° C. to 400° C. at an average temperature rising rate of 60° C./min or less and held at 600±3° C. for 5±3 minutes, which is a heating test in which the temperature is preferably raised from 300° C. to 400° C. at an average temperature rising rate of 60° C./min or less, preferably raised at 45° C./min or less, raised from 400° C. to 580° C. in 8±3 minutes, raised from 580° C. to the holding temperature in 8±3 minutes, and held at 600±3° C. for 5±3 minutes, the average grain size in a plane parallel to a rolled surface after the heating test is 370 μm or more, preferably 370 to 1500 μm, particularly preferably 400 to 1500 μm, and the average number of grains in the sheet thickness direction after the heating test is 1.5 pieces or more, preferably 1.5 to 10.0 pieces".

In the case of heat joining using the aluminum alloy sheet according to the present invention, the aluminum alloy sheet according to the present invention is formed into a predetermined shape, further combined with an opposing material to be joined, and then heated at the heat joining temperature to perform heat joining. In the heat joining using the aluminum alloy sheet according to the present invention, the appropriate heat joining temperature is within a temperature range in which the liquid phase ratio is 5 to 35%, and a time for which the liquid phase ratio is held at 5% or more is preferably 30 to 3600 seconds. The liquid phase ratio is preferably 5% or more because a small amount of liquid phase may make joining difficult. If the liquid phase ratio exceeds 35%, the amount of liquid phase formed is too large and the aluminum alloy material is greatly deformed during heat joining and cannot retain its shape. If the time for which the liquid phase ratio is 5% or more is less than 30 seconds, the joint may not be sufficiently filled with liquid phase, and if the time exceeds 3600 seconds, the aluminum material may be more deformed. To achieve these conditions, the heating temperature is set to 580° C. to 640° C. and the holding time at the heating temperature only needs to be set to be 0 to about 10 minutes during heat joining. Here, 0 minute means that cooling is started as soon as the temperature of the material reaches a predetermined joining temperature. As the heating conditions for heat joining, conditions that have been adjusted to an appropriate range to achieve a sound joining state without deformation may be used. A heating atmosphere during heat joining is preferably, for example, a non-oxidizing atmosphere in which air is replaced with nitrogen, argon, or the like. When a joined body is obtained in heat joining, even better joining performance can be obtained by using non-corrosive flux. Furthermore, in the heat joining, the joining can be performed by heating in a vacuum or under reduced pressure.

A heat exchanger according to the present invention is a heat exchanger comprising a tube made of aluminum alloy through which a working fluid flows and a fin made of aluminum alloy metallically joined to the tube, wherein the heat exchanger is obtained by combining at least a heat-exchanger tube material formed of an aluminum alloy and a heat-exchanger fin material formed of an aluminum alloy, and then heating the resulting combined body to join the heat-exchanger tube material and the heat-exchanger fin material, and the heat-exchanger fin material is a formed body of the aluminum alloy sheet according to the present invention.

The heat-exchanger tube material formed of an aluminum alloy for the heat exchanger according to the present invention is not limited to a particular one insofar as it is an aluminum alloy material, which is commonly used as a heat-exchanger tube material made of aluminum alloy, formed into a tubular shape.

The chemical composition of the aluminum alloy that forms the heat-exchanger tube material is not limited to a particular one, but examples of an aluminum alloy that forms a typical heat-exchanger tube material include 1000-series and 3000-series aluminum. Specifically, the examples include pure aluminum and an aluminum alloy comprising, with respect to the pure aluminum, one or two or more among: Si of 0.60 mass % or less; Fe of 0.70 mass % or less; Cu of 0.70 mass % or less; and Mn of 2.00 mass % or less, with the balance being Al and inevitable impurities.

The heat-exchanger fin material formed of an aluminum alloy for the heat exchanger according to the present invention is a formed body of the aluminum alloy sheet according to the present invention. The aluminum alloy sheet to be used for the heat-exchanger fin material of the heat exchanger according to the present invention is the same as the aluminum alloy sheet according to the present invention described above.

The heat exchanger according to the present invention is obtained by combining at least the heat-exchanger tube material formed of an aluminum alloy and the heat-exchanger fin material formed of an aluminum alloy, in addition to them, further combining necessary components such as a header, a tank, and a piping material, and heat joining their combined body.

The heating temperature during heat joining of the combined body is appropriately selected depending on the Si content. In addition to Si, Zn and Cu also exert an influence on the solidus temperature. Thus, when the aluminum alloy sheet according to the present invention comprises Zn and/or Cu in addition to Si, the heating temperature during heat joining of the combined body is appropriately selected depending on the contents of Si and Zn and/or Cu. The heating temperature for heat joining of the combined body is set within a temperature range in which the liquid phase ratio of the aluminum alloy sheet according to the present invention is 5 to 35%, and the time for which the liquid phase ratio is held at 5% or more is preferably 30 to 3600 seconds. The temperature rising rate during heat joining of the combined body is not uniquely specified and is appropriately selected in accordance with furnace structure and product design, but is generally 20 to 300° C./min.

In other words, the heat exchanger according to the present invention is a heat exchanger comprising a tube made of aluminum alloy through which a working fluid flows and a fin made of aluminum alloy metallically joined to the tube, wherein

- the tube is formed using a heat-exchanger tube material formed of an aluminum alloy,
- the fin is formed using an aluminum alloy sheet formed of an aluminum alloy comprising Si of 1.50 to 5.00 mass %, Fe of 0.01 to 2.00 mass %, and Mn of 0.50 to 2.00 mass % with the balance being Al and inevitable impurities, and having a function of heat joining in a single layer, and
- the average grain size in a plane parallel to a rolled surface of the fin is 370 μm or more, and the average number of grains in the sheet thickness direction is 1.5 pieces or more.

The heat exchanger according to the present invention is obtained by using the aluminum alloy sheet having the function of heat joining in a single layer as the fin material, and using the heat-exchanger tube material formed of an aluminum alloy as the opposing material, and heat joining them.

The fin for the heat exchanger according to the present invention is formed using the aluminum alloy sheet having the function of heat joining in a single layer. For example, the fin for the heat exchanger according to the present invention is formed using the above-described aluminum alloy sheet according to the present invention.

The aluminum alloy that forms the fin for the heat exchanger according to the present invention is an aluminum alloy comprising: Si of 1.50 to 5.00 mass %, preferably 1.60 to 3.50 mass %, more preferably 2.00 to 3.00 mass %; Fe of 0.01 to 2.00 mass %, preferably 0.20 to 1.00 mass %; and Mn of 0.50 to 2.00 mass %, preferably 0.80 to 1.50 mass %, with the balance being Al and inevitable impurities. The aluminum alloy that forms the fin material for the heat exchanger according to the present invention may further comprise, if necessary, as optional additive elements, any one or two or more among: Zn of 6.00 mass % or less, preferably 0.05 to 6.00 mass %, particularly preferably 0.10 to 5.00 mass %; Mg of 3.00 mass % or less, preferably 0.05 to 3.00 mass %; Cu of 1.50 mass % or less, preferably 0.05 to 1.50 mass %; Ni of 2.00 mass % or less, 0.05 to 2.00 mass %; Cr of 0.30 mass % or less, preferably 0.05 to 0.30 mass %; Zr of 0.30 mass % or less, preferably 0.05 to 0.30 mass %; Ti of 0.30 mass % or less, preferably 0.05 to 0.30 mass %; V of 0.30 mass % or less, preferably 0.05 to 0.30 mass %; Be of 0.10 mass % or less, preferably 0.0001 to 0.10 mass %; Sr of 0.10 mass % or less, preferably 0.0001 to 0.10 mass %; Bi of 0.30 mass % or less, preferably 0.0001 to 0.30 mass %; Na of 0.10 mass % or less, preferably 0.0001 to 0.10 mass %; and Ca of 0.05 mass % or less, preferably 0.0001 to 0.05 mass %. The aluminum alloy for the aluminum alloy sheet according to the present invention may also comprise: In of 0.10 mass % or less, preferably 0.0001 to 0.10 mass %; Sn of 0.10% or less, preferably 0.0001 to 0.10 mass %; Be of 0.10 mass % or less, preferably 0.0001 to 0.10 mass %; and rare earth elements of 0.10 mass % or less, preferably 0.0001 to 0.10 mass %.

The average grain size in a plane parallel to a rolling surface of the fin for the heat exchanger according to the present invention is 370 μm or more, preferably 370 to 1500 μm, particularly preferably 400 to 1500 μm, and the average number of grains in the sheet thickness direction is 1.5 pieces or more, preferably 1.5 to 10.0. When the average grain size in a plane parallel to a rolled surface of a fin and the average number of grains in the sheet thickness direction are within the above-described ranges, a heat exchanger can be obtained in which deformation, fin buckling, or fin melting due to contact with surrounding members is less likely to occur, because of less deformation of the fin material during heat joining.

The aluminum alloy that forms the tube for the heat exchanger according to the present invention is not limited to a particular one insofar as it is an aluminum alloy that is commonly used as a tube for a heat exchanger made of aluminum alloy. The chemical composition of the aluminum alloy that forms the tube is not limited to a particular one, but examples of an aluminum alloy that forms a typical heat-exchanger tube material include 1000-series and 3000-series aluminum. Specifically, the examples include pure aluminum and an aluminum alloy comprising, with respect to the pure aluminum, one or two or more among: Si of 0.60 mass % or less, Fe of 0.70 mass % or less, Cu of 0.70 mass % or less, Mn of 2.00 mass % or less, with the balance being Al and inevitable impurities.

Examples will be given below to specifically describe the present invention, but the present invention is not limited to the Examples given below.

EXAMPLES

Examples 1 to 3, Comparative Examples 1 and 2

Aluminum alloys having chemical compositions A1 to A2 given in Table 1 were used to cast cast-rolled sheets by twin-roll continuous casting rolling. In the chemical compositions in Table 1, "-" represents that the content is at a detection limit or less, and "balance" includes inevitable impurities. The molten metal temperature during casting by the twin-roll continuous casting rolling was 650 to 800° C., and the thickness of the cast-rolled sheets was 6 mm. The casting speed was set to 700 mm/min.

Subsequently, the resulting plate-like cast-rolled sheets were annealed at 395° C. for 2 hours, and then cold rolled to the thicknesses given in Table 2 (after the first cold rolling). Subsequently, annealing was performed at 370° C. for 2 hours, and then the resulting sheets were cold rolled to a thickness of 0.070 mm, whereby samples (final sheets) were obtained.

In Examples 1 to 3 above, the cold-rolling step was performed twice and annealing was performed twice: after the casting step; and between the first cold rolling and the second cold rolling at the cold-rolling step.

Comparison Example 3

The cast-rolled sheet of the chemical composition A3 given in Table 1 was cast by the DC casting method. To begin with, an ingot having a thickness of 500 mm, a width of 900 mm, and a length of 2900 mm was cast. The casting speed was set to 50 mm/min. Subsequently, the ingot cast by the DC casting method was faced, and then the ingot was heated and held at that temperature as a heating and holding step before hot rolling. Subsequently, a hot-rolling step was performed. In the hot-rolling step, the sheet was rolled to a thickness of 2 mm.

The sheet was then cold rolled to the thickness given in Table 2 (after the first cold rolling). Subsequently, the rolled material was annealed at 370° C. for 2 hours, and was then cold rolled to a thickness of 0.070 mm, whereby a sample (final sheet) was obtained.

For each of the above samples, the average grain size in a plane parallel to a rolling direction and the average number of grains in the sheet thickness direction were measured after the heating test. A deformation resistance test was also conducted. The results are given in Table 2.

<Heating Test>

The samples were heated in an atmosphere of inert gas such that the temperature thereof was raised from 300° C. to 400° C. at a temperature rising rate of 41° C./min, from 400° C. to 580° C. in 7.2 minutes, from 580° C. to 600° C. in 7.4 minutes, and to a holding temperature of 600±3° C., and was then held at 600±3° C. for 4.7 minutes. Subsequently, they were cooled to room temperature, whereby test materials after the heating test were obtained.

<Average Grain Size in a Plane Parallel to a Rolled Surface>

The surface of each test material after the heating test was mirror polished, etched by an anodic oxidation method, and observed with an optical microscope (50-fold magnification) to obtain a grain structure observation image. From the obtained grain structure observation image, the average grain size was measured by the area measurement method. Specifically, a rectangle of 1.6 mm in length and 2.0 mm in width was drawn on the grain structure observation image, grains encompassed thereby were each counted as 1 and grains cut by the sides of the rectangle were each counted as 0.5, and the number of grains within the rectangle and on the rectangle was measured. This measurement was performed on any three views of the test material, the grains were measured, and the average grain size d was calculated using the following formula (1).

$$\text{Average grain size } d\ (\mu m) = ((\text{Total evaluated area } (\mu m^2)/\text{Total number of grains (pcs)}))^{0.5} \quad (1)$$

<Average Number of Grains in the Sheet Thickness Direction>

Each test material after the heating test was embedded in a resin, mirror polished such that a cross-section thereof was exposed, and etched by the anodic oxidation method. The resulting sample was observed with the optical microscope at 100-fold magnification to obtain a grain structure observation image of a cross-section corresponding to a length of 3.6 mm. As illustrated in FIG. 5, cutting-plane lines were drawn at regular intervals of 200 μm, the number of grains present on the cutting-plane lines was measured, and the average number of grains in the sheet thickness direction was measured using the following formula (2).

$$\text{Average number of grains (pcs)} = \text{Total number of grains on all cutting-plane lines}/\text{Number of cutting-plane lines} \quad (2)$$

<Deformation Resistance>

Figure 6:
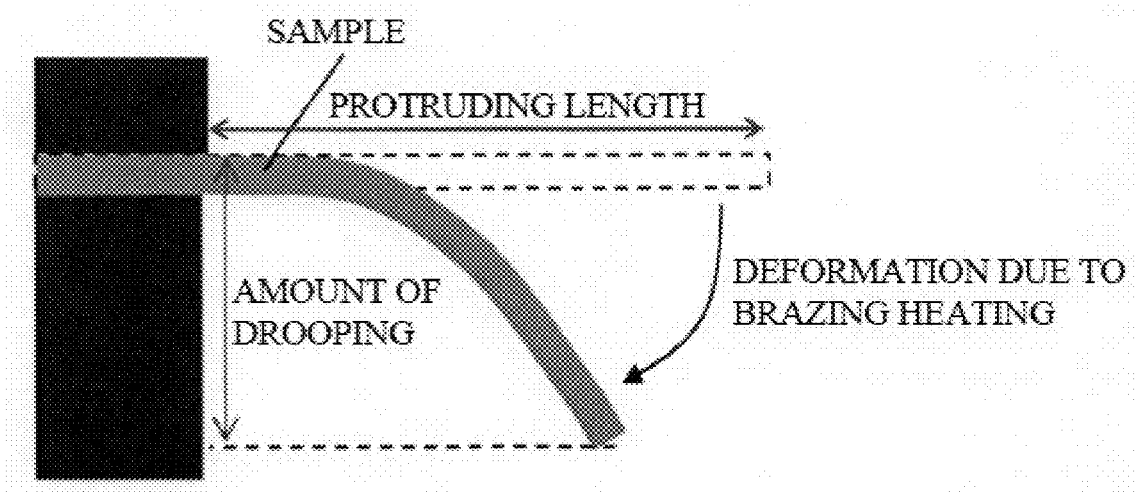
FIG. 6 is a schematic diagram of a deformation resistance test.

FIG. 6 is a schematic diagram of the deformation resistance test. Each sample was cut into a piece having a width of 16 mm and a length of 80 mm, and the cut piece was heated to 600° C. in an atmosphere of nitrogen and held for 3 minutes while being fixed to a jig such that the protruding length thereof was 50 mm. The amount of drooping of the sample after being held was measured, it was determined to be "0" if it was 45 mm or less, and it was determined to be "x" if it exceeded 45 mm.

TABLE 1

| | Chemical composition (mass %) | | | | | |
|---|---|---|---|---|---|---|
| No. | Si | Fe | Mn | Mg | Zn | A |
| A1 | 2.50 | 0.20 | 1.10 | — | 1.50 | balance |
| A2 | 2.40 | 0.20 | 1.10 | 0.05 | 1.50 | balance |
| A3 | 2.40 | 0.20 | 1.20 | — | 1.40 | balance |

TABLE 2

| | Example 1 | Example 2 | Example 3 | Comparative Example 1 | Comparative Example 2 | Comparative Example 3 |
|---|---|---|---|---|---|---|
| Alloy | A1 | A2 | A2 | A2 | A2 | A3 |
| Casting method | CC | CC | CC | CC | CC | DC |
| First annealing conditions | | | | | | |
| Temperature (° C.) | 395 | 395 | 395 | 395 | 395 | — |
| Time (hours) | 2 | 2 | 2 | 2 | 2 | — |
| First cold rolling | | | | | | |
| Thickness after rolling (mm) | 0.100 | 0.088 | 0.140 | 0.082 | 0.078 | 0.079 |

TABLE 2-continued

| | Example 1 | Example 2 | Example 3 | Comparative Example 1 | Comparative Example 2 | Comparative Example 3 |
|---|---|---|---|---|---|---|
| Second annealing conditions | | | | | | |
| Temperature (° C.) | 370 | 370 | 370 | 370 | 370 | 370 |
| Time (hours) | 2 | 2 | 2 | 2 | 2 | 2 |
| Second cold rolling | | | | | | |
| Thickness after rolling (mm) | 0.070 | 0.070 | 0.070 | 0.070 | 0.070 | 0.070 |
| Reduction (%) | 30 | 20 | 50 | 15 | 10 | 11 |
| Average grain size (um) | 763 | 894 | 513 | 328 | 350 | 573 |
| Number of average grains (pcs) | 1.9 | 1.5 | 2.1 | 1.3 | 1.7 | 1.0 |
| Deformation resistance test | | | | | | |
| Amount of drooping (mm) | 35.0 | 41.1 | 36.5 | 50.0 | 49.7 | 47.7 |
| Determination | ○ | ○ | ○ | × | × | × |

Casting method CC: Twin-roll continuous casting rolling

Casting method DC: DC casting

Average grain size: Average grain size in a plane parallel to a rolled surface after heating test Average number of grains: Average number of grains in the sheet thickness direction after heating test As can be seen from Table 2, in Examples 1 to 3, both the average grain size in a plane parallel to a rolled surface after the heating test and the average number of grains in the sheet thickness direction after the heating test satisfied the requirements of the present invention, and the deformation resistance was excellent.

By contrast, in Comparative Example 1, both the average grain size in a plane parallel to a rolled surface after the heating test and the average number of grains in the sheet thickness direction failed to satisfy the requirements of the present invention, and the deformation resistance was unacceptable. In Comparative Example 2, the average number of grains in the sheet thickness direction satisfied the requirement of the present invention, but the average grain size in a plane parallel to a rolled surface failed to satisfy the requirements of the present invention, and the deformation resistance was unacceptable. In Comparative Example 3, the average grain size in a plane parallel to a rolled surface satisfied the requirement of the present invention, but the average number of grains in the sheet thickness direction failed to satisfy the requirements of the present invention, and the deformation resistance was unacceptable.

(Heat Joining Test)

The sample obtained in Example 1 was combined with an A3003 aluminum alloy O-material sheet having a thickness of 1 mm to prepare a combined body for a joining test.

Subsequently, the combined body for the joining test was heated in an atmosphere of inert gas such that the temperature is raised from 300° C. to 400° C. at a temperature rising rate of 56° C./min, from 400° C. to 580° C. in 8.1 minutes, raised from 580° C. to 600° C. in 3.5 minutes, and to a holding temperature of 600±3° C., and then held at 600±3° C. for 4.7 minutes. The combined body was then cooled to room temperature and heat joined.

Figure 7:
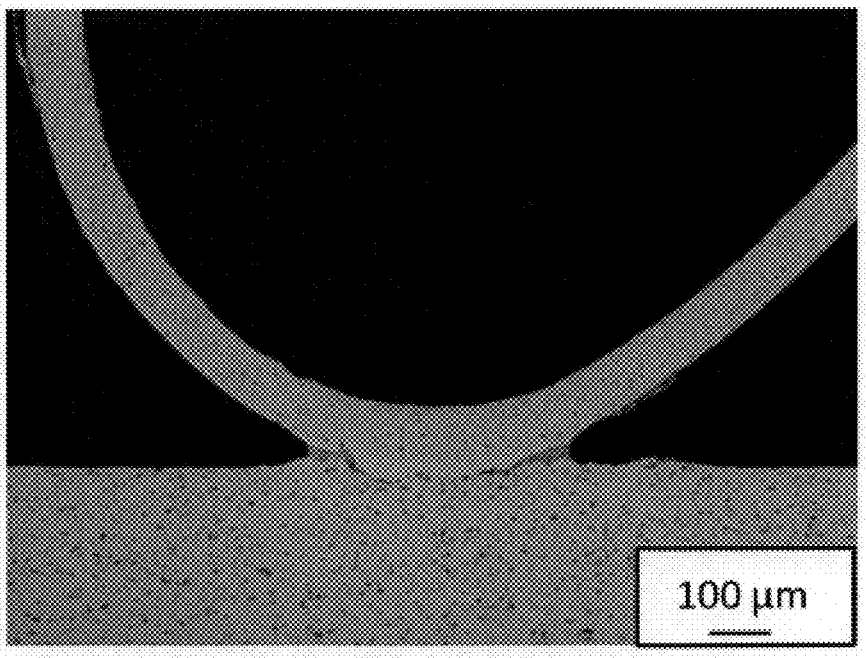
FIG. 7 is a result of a heat joining test of a sample in Example 1.

The joint of the resulting joined body was observed with the optical microscope (100-fold magnification). The result is given in FIG. 7.

As the result of the heat joining test, the sample obtained in Example 1 had the function of heat joining in a single layer. The Si content and the Zn content in the samples obtained in Examples 2 and 3 are similar to those in Example 1, and thus it is assumed that the samples obtained in Examples 2 and 3 have the function of heat joining in a single layer similarly to the sample obtained in Example 1.

The invention claimed is:

1. An aluminum alloy sheet having a function of heat joining in a single layer, the aluminum alloy sheet formed of an aluminum alloy comprising: Si of 1.50 to 5.00 mass %; Fe of 0.01 to 2.00 mass %; and Mn of 0.50 to 2.00 mass %, and optionally any one or two or more among Zn of 6.00 mass % or less, Mg of 3.00 mass % or less, Cu of 1.50 mass % or less, Ni of 2.00 mass % or less, Cr of 0.30 mass % or less, Zr of 0.30 mass % or less, Ti of 0.30 mass % or less, and V of 0.30 mass % or less, and optionally any one or two or more among Be of 0.10 mass % or less, Sr of 0.10 mass % or less, Bi of 0.30 mass or less, Na of 0.10 mass % or less, and Ca of 0.05 mass % or less, wherein the aluminum alloy sheet is formed of the aluminum alloy as a single-layer brazing sheet; and in a heating test in which a temperature is raised from 300° C. to 400° C. at an average temperature rising rate of 60° C./min or less and held at 600±3° C. for 5±3 minutes, average grain size in a plane parallel to a rolled surface after the heating test is 370 μm or more, and an average number of grains in a sheet thickness direction after the heating test is 1.5 pieces or more.

2. The aluminum alloy sheet according to claim 1, wherein a sheet thickness is 0.30 mm or less.

3. A heat exchanger comprising a tube made of aluminum alloy through which a working fluid flows and a fin made of aluminum alloy metallically joined to the tube, wherein the heat exchanger is obtained by combining at least a heat-exchanger tube material formed of an aluminum alloy and a heat-exchanger fin material formed of an aluminum alloy, and then heating the resulting combined body to join the heat-exchanger tube material and the heat-exchanger fin material, and the heat-exchanger fin material is a formed body of the aluminum alloy sheet according to claim 1.

4. The aluminum alloy sheet according to claim 1, wherein the aluminum alloy comprises a balance being Al and inevitable impurities.

5. The aluminum alloy sheet according to claim 1, wherein the average grain size in a plane parallel to a rolled surface after the heating test is 400 μm to 1500 μm, and an average number of grains in a sheet thickness direction after the heating test is 1.5 to 10.0 pieces.

6. The aluminum alloy sheet according to claim 1, wherein the aluminum alloy comprises Si of 2.00 to 3.00 mass %, Fe of 0.20 to 1.00 mass %, and Mn of 0.80 to 1.50 mass %.

7. The aluminum alloy sheet according to claim 1, wherein the aluminum alloy sheet has the function of heat joining in a single layer at a temperature at which a liquid phase ratio is 5.0% or more and 35.0% or less.

8. A heat exchanger comprising a tube made of aluminum alloy through which a working fluid flows and a fin made of aluminum alloy metallically joined to the tube, wherein the tube is formed using a heat-exchanger tube material formed of an aluminum alloy, the fin is formed using an aluminum alloy sheet formed of an aluminum alloy comprising Si of 1.50 to 5.00 mass %, Fe of 0.01 to 2.00 mass %, and Mn of 0.50 to 2.00 mass %, and optionally any one or two or more among Zn of 6.00 mass % or less, Mg of 3.00 mass % or less, Cu of 1.50 mass % or less, Ni of 2.00 mass % or less, Cr of 0.30 mass % or less, Zr of 0.30 mass % or less, Ti of 0.30 mass % or less, and V of 0.30 mass % or less, and optionally any one or two or more among Be of 0.10 mass % or less, Sr of 0.10 mass % or less, Bi of 0.30 mass % or less, Na of 0.10 mass % or less, and Ca of 0.05 mass % or less, with a balance being Al and inevitable impurities, and having a function of heat joining in a single layer, average grain size in a plane parallel to a rolled surface of the fin is 370 μm or more, and an average number of grains in a sheet thickness direction is 1.5 pieces or more.

* * * * *